United States Patent [19]

Break

[11] 4,282,735

[45] Aug. 11, 1981

[54] BRAKE FOR SHEET METAL OR THE LIKE

[75] Inventor: Douglas G. Break, Farmington Hills, Mich.

[73] Assignee: Van Mark Products Corporation, Farmington Hills, Mich.

[21] Appl. No.: 68,389

[22] Filed: Aug. 21, 1979

Related U.S. Application Data

[63] Continuation-in-part of Ser. No. 25,844, Apr. 2, 1979, abandoned.

[51] Int. Cl.[3] ..... B21D 5/04

[52] U.S. Cl. ..... 72/319; 72/465

[58] Field of Search ..... 72/319, 320, 321, 388, 72/458, 459, 465, DIG. 14; 16/128 R

[56] References Cited

U.S. PATENT DOCUMENTS

| | | | |
|---|---|---|---|
| 2,136,729 | 11/1938 | Stahl | 16/128 R |
| 2,160,441 | 5/1939 | Peters | 72/320 |
| 3,380,280 | 4/1968 | Wise | 72/319 |
| 3,482,427 | 12/1969 | Barnack | 72/319 |
| 4,111,027 | 9/1978 | Bottomley | 72/320 |

*Primary Examiner*—Lowell A. Larson
*Attorney, Agent, or Firm*—H. P. Settle

[57] ABSTRACT

A brake for bending sheet metal and including a bending leaf which is hinged to the workpiece clamping portions of the break by means of an integrally extruded, pin-less hinge. The bending leaf also is provided with an offset handle, so that the workpiece contacting portion of the bending leaf is of reduced size to fit within a previously formed portion of the workpiece. The hinge design includes interfitting protuberence and recess elements which are assembled by axial sliding movement, but which cannot radially disengage over the entire pivot range of the hinge, which range is sufficient to bend the workpiece over 90°.

13 Claims, 10 Drawing Figures

FIG. 1
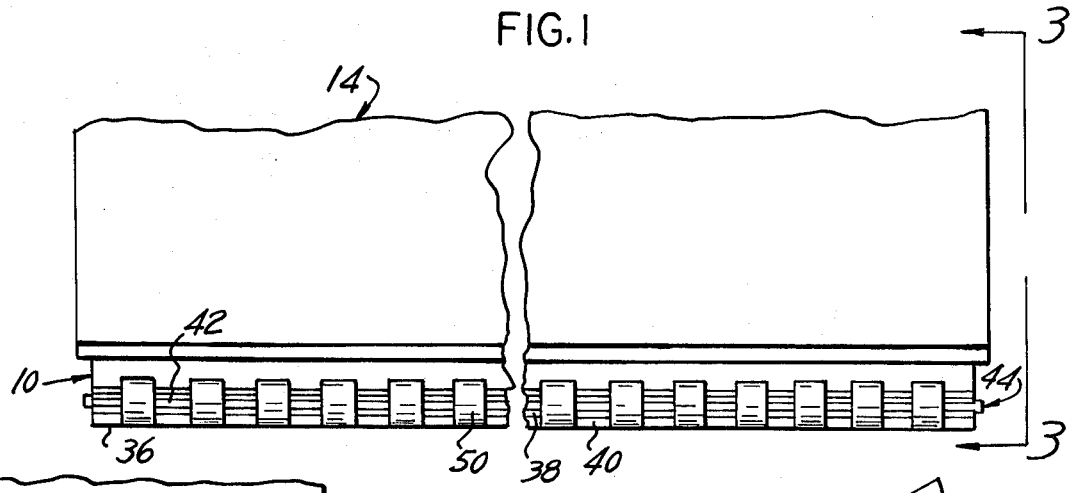
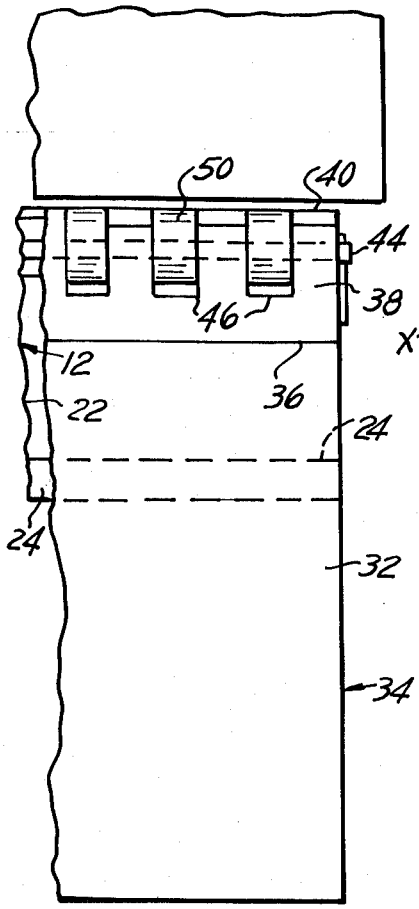
FIG. 2
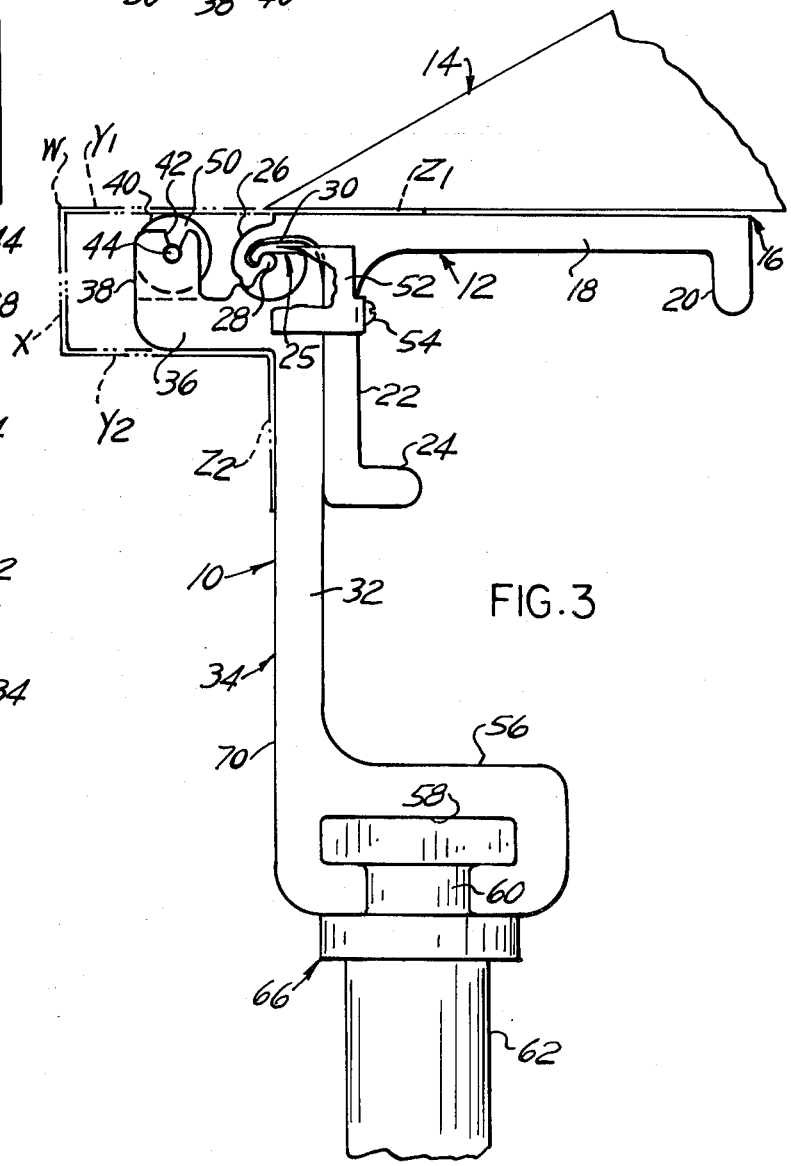
FIG. 3

W
X
Y2
Y1
Z2
Z1
14
16
18
20
22
24
25
26
28
30
32
34
36
38
44
50
52
54
56
58
60
62
64
66
68
70
10
12

BRAKE FOR SHEET METAL OR THE LIKE

CROSS REFERENCE

This application is a continuation-in-part of my prior application Ser. No. 25,844, filed Apr. 2, 1979 entitled "Device For Producing Sheet Metal Channel Workpiece in a Sheel Metal Bending Brake", now abandoned.

BACKGROUND OF THE INVENTION

Many forms of brakes for bending sheet materials or the like are known. In general, there is provided a base of suitable type to which the sheet metal is clamped by a clamping jaw having an edge against which the metal is bent. The workpiece is clamped between the anvil jaw and the base, and a bending leaf is pivotally attached to the base adjacent and beneath the clamping jaw edge. As the bending leaf is raised, the bending leaf contacts the workpiece to bend the metal upwardly about the front edge of the clamping jaw.

The prior art may be exemplified by such patents as U.S. Pat. No. 3,592,037 granted to Van Cleave, July 13, 1971 for "Sheet Metal Bending Brake"; U.S. Pat. No. 4,092,481 to Chambers, Jr., on June 6, 1978 for "Sheet Metal Brake"; U.S. Pat. No. 3,147,791 to Rauen et al., on Sept. 8, 1964 for "Brake for Bending Sheet Metal"; and my U.S. Pat. No. 4,081,987 granted on Apr. 4, 1978, for "Wide-Range Sheet Material Bending Brake".

As illustrated in these and other patents it has been customary heretofore to use a piano type hinge which acts as a bearing for the bending leaf. In the forms exemplified above, the piano hinge or bearing is exposed to dirt. Furthermore, this form of bearing requires a pin for attaching the bending leaf to the base or frame of the brake. Even where the hinge elements are integral with the bending leaf and the base, the formation of the interdigited hinge projections and the insertion of the hinge pin requires milling of the hinge elements, cleaning of the pin holes, etc.

SUMMARY OF THE INVENTION

One feature of the invention resides in a flanged channel workpiece bending device including an unfolded Z-shaped workpiece structure pivoted to the lower fixed workpiece clamping jaw immediately below the therewithaligned forward edge of the moveable workpiece-clamping jaw. Another feature resides in the pressure applicator having multiple axially-shaped pressure-applying rollers of rigid plastic material for preventing damage to the sheet metal during the wiping action occurring while the sheet metal or workpiece is being bent. A further feature involves a T-slot at the bottom of the workpiece bending structure for slidably and detachably receiving the corresponding shaped opposite ends of the handle bar by which the crank or bending device is moved upward during the bending operation. It will be understood in the description and claims that the various references to orientation, such as upward, lower, forward, etc. are applied as descriptive of the brake in its usual orientation during operation which is with the workpiece horizontal and clasped within the jaws, with the upper jaw against the edge of which the workpiece is to be bent, in a horizontal line, and the forward part of the workpiece extending outwardly from that jaw, while the remaining portion is clamped within and backward of the jaw.

Another feature of the invention resides in an integral hinge structure carried on the frame or base and which may be assembled or dissembled axially, but when engaged cannot be disengaged radially. Also, the axis of the hinge is parallel to the edge of the clamping jaw against which the workpiece is to be bent and the clamping jaw edge and the hinge axis both lie in a plane which is perpendicular to the plane of the clamped workpiece. Further, the bending arm of the bending leaf projects horizontally from the hinge pin and is of a reduced size so that the bending leaf can make a final bend in a U-shaped channel having two right angle bends defining parallel, closely spaced channel walls by inserting the bending arm between the channel walls. Also, the bending arm is provided with a resilient filler which protects the bearing from dirt and aids in bending.

BRIEF DESCRIPTION OF THE DRAWINGS

The various objects, advantages and novel features of the invention will be more fully apparent from the following detailed description when read in conjunction with the drawing, in which:

FIG. 1 is a fragmentary top plan view on a reduced scale of the forward portion of a conventional sheet metal bending brake pivotally equipped with the optionally-flanged channel-bending device according to the present invention;

FIG. 2 is an enlarged front elevation of the right-hand corner portion of FIG. 1, with the handle bar omitted;

FIG. 3 is an enlarged side elevation of the forward portion of the brake looking in the direction of the arrows 3—3 in FIG. 1 with the flanged channel bending device shown in its starting position for making the next bend in a flanged channel workpiece shown in chain lines therein, and with the pivot shaft retaining plate partly broken away to disclose the pivotal connection;

DETAILED DESCRIPTION

A. Embodiment of FIGS. 1–5

Figures 4, 5, 6, 7:
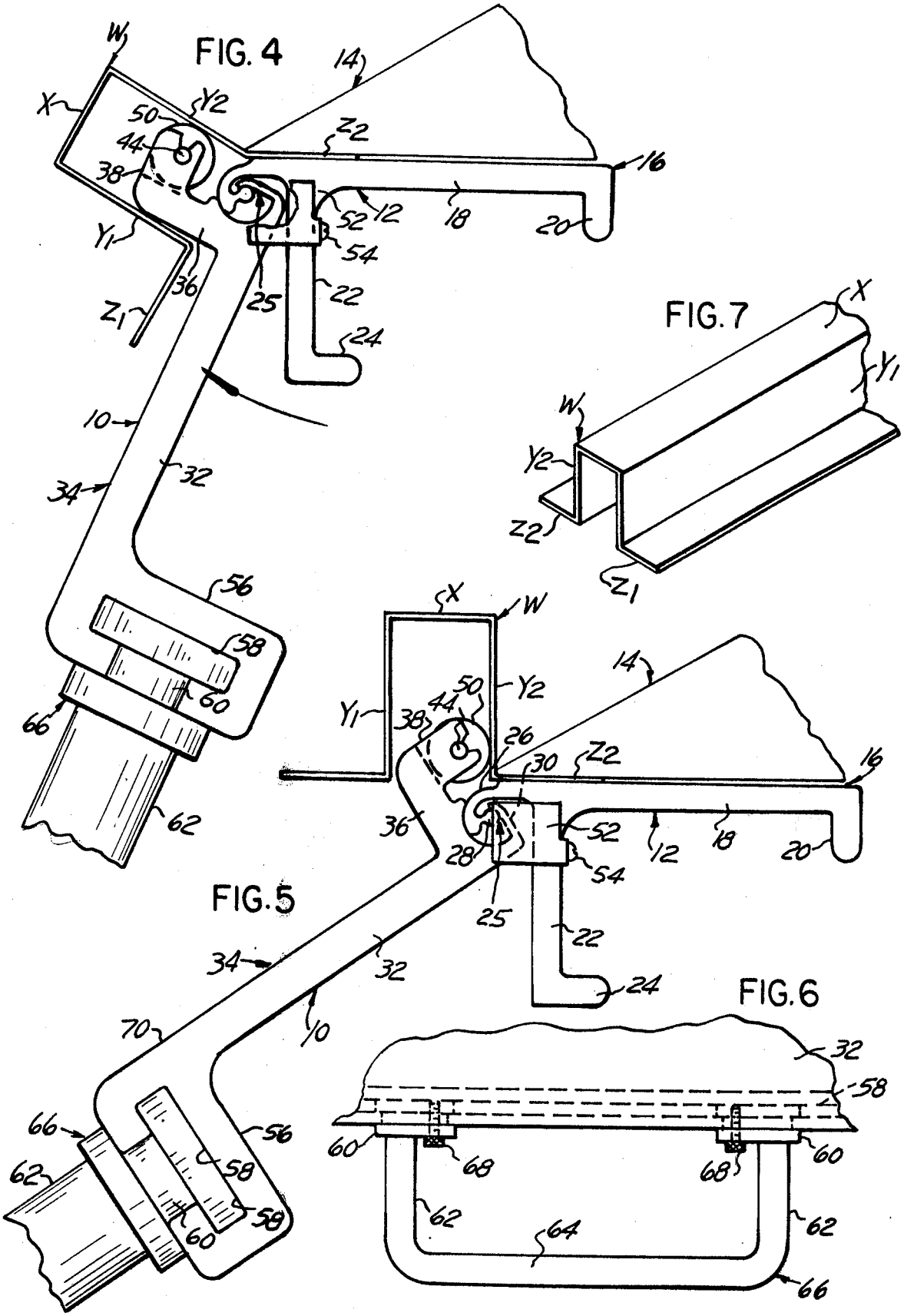
FIG. 4 is a view similar to FIG. 3 and similarly broken away, but with the crank swung in the direction of the arcuate arrow as indicated to produce the final side flange of the flanged channel workpiece illustrated in the figure.
FIG. 5 is a view similar to FIGS. 3 and 4, but showing the crank in its final position in the formation of a flanged channel workpiece.
FIG. 6 is a front elevation on a reduced scale of the handle bar or lever arm or arms of the crank, the upper part of which is shown in FIGS. 3, 4 and 5 and which appears in its starting position corresponding to that of FIG. 3.
FIG. 7 is a perspective view, on a reduced scale, of a portion of the flanged channel workpiece produced in the brake of the present invention.

Referring to the drawings in detail, FIGS. 1 to 5, inclusive show an optionally-flanged channel bending device, generally designated 10, as applied to the fixed lower workpiece clamping jaw 12 which with an upper wedge-shaped moveable clamping jaw and anvil 14 form the parts of a conventional bending brake 16 to which the flanged channel bending device 10 is pivotally attached and with which it cooperates to bend a workpiece W of sheet metal into a channel (FIG. 7) with a web or bottom X from which side walls Y-1 and Y-2 extend at right angles to the web X and form the remote edges of which flanges Z-1 and Z-2 extend outward at right angles to the side walls Y-1 and Y-2. Thus, the brake is adapted to produce a flanged product having two right angle flanges extending from a U-shaped channel having two right angle bends at the bottom of the channel. The bending brake 16 to which the bending device 10 is attached may be the one disclosed and claimed in my prior U.S. Pat. No. 4,081,986 issued Apr. 4, 1978, for "Wide-Range Sheet Material Bending Brake", or it may be any other suitable conventional bending brake. By this I mean that the bending brake of my prior patent is modified in such a way as to attach the device 10. It is well known among those skilled in the sheet metal bending art that suitable conventional mechanism is provided for moving the moveable clamping jaw 14 toward and away from the affixed stationary clamping jaw 12 with the workpiece W held therebetween during the bending operations described below. Thus, the flanged channel bending device 10 may be considered as an attachment to be pivotally connected to the fixed or stationary clamping jaw 12 in substitution for the conventional bending device thereof for bending the workpiece W while the sheet metal of which it is composed is held down against the fixed jaw 12 by the moveable jaw 14. The jaws 12 and 14 are pivoted to one and other remote from the bending device 10 as shown in my above-mentioned U.S. Pat. No. 4,081,986, and clamped together by any suitable means, such as by the cam-operated mechanism shown in said patent. The clamping means, as indicated by the legend in FIG. 3 applied to the jaw or anvil 14 are related to a base or frame so that the anvil 14 is moved down to clamp the workpiece, as explained in the said patent. Although the means described in the patent are preferred, other clamping means may be employed for causing the jaw or anvil 14 to clamp the workpiece between the jaw 14 and the lower jaw 12.

Referring particularly to FIGS. 3, 4 and 5, the fixed or stationary jaw 12 to which the flanged channel bending device 10 is attached has a central horizontal web portion 18 in the form of an elongated plate having a short rearward flange or rib 20 extending downward from its rearward edge and near its forward edge having a wider vertical stop flange 22 terminating in a shorter or narrower horizontal flange or rib 24. The bending device 10 and the lower fixed workclamping jaw 12 are pivotally joined to one another by a suitable horizontal pivotal connection, generally designated 25. In particular, extending downward along the forward edge of the fixed jaw 12 is a stationary pivot component 26 of approximately C-shaped cross-section terminating in a pivot rib 28 of proponderantly circular cross-section. Cooperating with the stationary pivot rib 28 is a forwardly-extending round-ended moveable pivot component 30 which extends over and pivotally engages the stationary pivot rib 28. The moveable pivot component 30 extends upward from the upper end of the vertical plate portion 32 of the unfolded Z-shaped bending support, generally designated 34. The latter consists of the longitudinally-extending vertical plate 32 from the upper end of which at its junction with the moveable pivot component portion 30 a horizontal upper flange 36 extends forward and terminates in multiple axially-spaced upstanding bosses 38 provided along their upper ends 40 with aligned key-hole-shaped pivot grooves 42, in the lower circular portions of which is mounted a roller shaft 44 (FIG. 3). Rotatably mounted on the shaft 44 in the rectangular notches 46 between the upstanding bosses 38 are pressure rollers 50 (FIGS. 1 and 2) preferably of hard synthetic plastic material, such as nylon. The cooperating fixed and moveable pivot portions 28 and 30 are held in assembly lengthwise of their mutual axis by retaining plates 52 secured to the opposite ends of the vertical flange 22 by fasteners 54.

The vertical plate portion 32 of the unfolded Z-shaped bending support 34 terminates at its lower end in a rearwardly-extending thick horizontal lower flange 56 (FIGS. 3, 4, 5 and 6). The lower flange 56 is provided with a longitudinal slot 58 of T-shaped cross-section which slidably receives correspondingly-shaped slide blocks or heads 60 of I-shaped cross-section secured to the upper or inner ends of the parallel arms 62 extending from the elongated portion 64 of a handle bar 66 by which the bending assembly 10 is manipulated, as described below in connection with the operation of the invention. The slide blocks 60 and the flanges 56 are drilled and threaded in alignment to receive threaded fasteners or thumb screws 68.

The unfolded Z-shaped bending support 34 may be considered in its entirety as a crank. The stationary pivot component 26 may be considered as a bearing having two external cylindrical bearing surfaces, one 26A and one 26B on the pivot rib 28. The cylindrical surfaces 26A and 26B both have radii centered on the axis or axial line 27. The vertical axially extended plate portion 32 is one arm of the crank. The other arm of the crank comprises the flange 36 and the upstanding bosses 38, which together constitute a head 37 for operating on the workpiece.

The moveable pivot component comprises an internal cylindrical surface 30A, which, when assembled with the stationary pivot component 26, bears against the external cylindrical surface 26A. Meanwhile, when assembled, an internal surface of the projection 31 of the vertical plate portion 32 bears against the external cylindrical surface 26B. At the closest approach of the extension 31 to the internal surface 30A, the distance S (See FIG. 4) between the surfaces 31B and 30A is less than the sum of the radii of the cylindrical surfaces 26A and 26B. The result of this geometric arrangement is that the stationary pivot component 26 acts as a bearing for the moveable pivot component 30, and when they are assembled together they cannot be disengaged radially of the axis 27. These parts can be engaged and disengaged axially only. The stationary pivot component 26 acts as a bearing for the crank and the lever arm 32 acts as the crank drive arm. When force is applied to turn the lever arm 32 in a clockwise direction (or a counterclockwise direction) it turns about the bearing formed by the stationary pivot component 26 and the bearing axis 27, and also turns the head 37 which forms the other or driven arm of the crank.

Still another way of describing the structure is to consider the radially elongated crank 34 as a bending leaf. The leaf is coextensive with the base. The pivot component 26 is effectively a pivot lip projecting forwardly from the base and which has an exterior convex bearing surface, the surface 26A, and an interior recess. In the recess is the pivot rib or cylindrical enlargement having convex bearing surface 26B which, as noted above, is coaxial with that of the exterior bearing surface 26A at the axial line 27. The arcuate concave bearing wall affording the surface 30A of the component 30 and the lip or projection 31 coact respectively with the arcuate bearing surface 26A and the recess enlargement to provide a means for hingedly interconnecting the bending leaf and the base. The projection 31 extends into the lip recess and contacts the enlargement 31.

When in its initial fiducial position ready for operation and a workpiece clamped in place (assuming the workpiece is planar and has a planar portion extending from the jaw 14 forward) the actuating portion of the bending leaf, that is, the crank arm 32 lies on one side of a plane which includes both the axis 27 and the edge of the jaw 14 and is perpendicular to the plane of the workpiece, as illustrated in FIG. 3. The bending portion of the bending leaf or head 37 of the crank extends on the other side from the crank drive arm 32 of this plane perpendicular to the planar workpiece.

Operation

In operation of the invention, the conventional bending brake is prepared for the reception of the flanged channel workpiece bending device of the present invention by removing its conventional bending device from its pivotal connection with the lower clamping jaw 12 of the conventional bending brake and replacing it with the present flanged channel bending device. It is of course assumed that the pivotal connection of the bending device 10 with the lower fixed clamping jaw 12 will be made compatible with the pivotal construction of the latter, and not necessarily the cooperating hook-like pivotal connection 25 shown in the present drawings. Whatever the pivotal connection adopted, it is so constructed and arranged as to place the front surface 70 of the vertical plate portion 32 of the bending support 34 in vertical alignment with the pivot axis of the pivotal connection 25.

Figure 8:
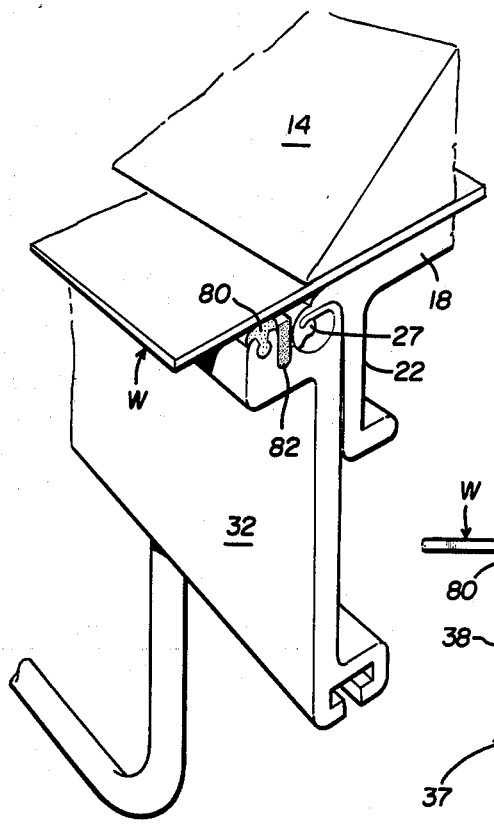
FIG. 8 is a partial perspective view of a modification of the brake of FIGS. 1–6.
Figure 9:
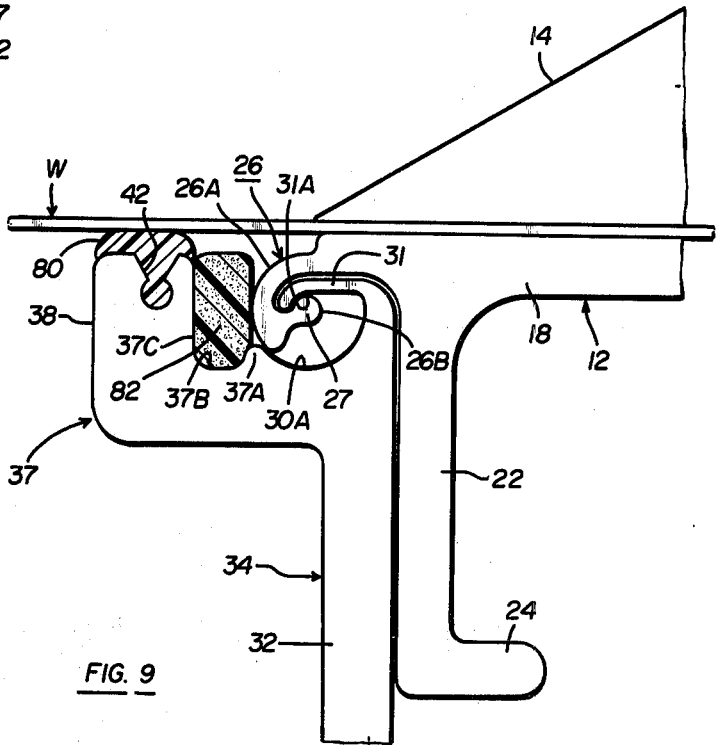
FIG. 9 is an enlarged end view of a portion of the device of FIG. 8 taken along the lines 9—9 of FIG. 8 omitting an end-plate.
Figure 10:
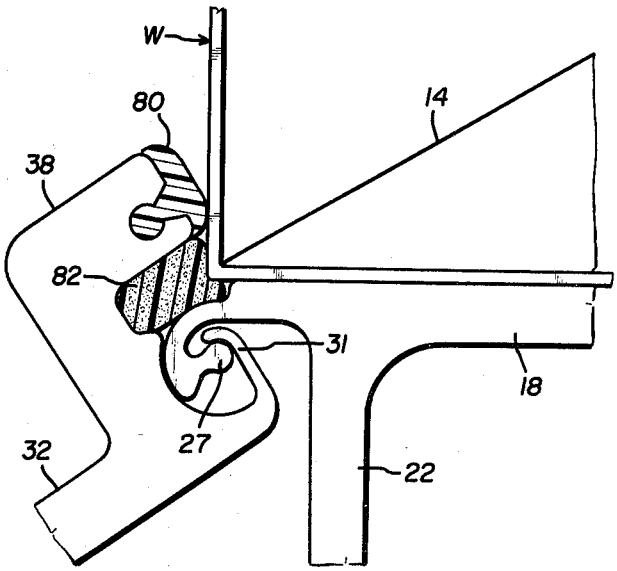
FIG. 10 is an enlarged end view of the brake of FIG. 8 like that of FIG. 9 except that the crank has been turned in order to bend the workpiece against the jaw of the anvil.

Other types of bearing than the stationary pivot component 26 may be employed, for the crank. Such bearings may also cooperate with the crank to permit axial engagement and disengagement and no radial disengagement, as does the illustrated bearing. The bearing as described may be formed by extrusion. Thus, both the base and particularly the portion of the base involving the pivot component or lip 26 and the bending device or bending leaf and the parts coacting with the lip may be extruded. Thus, the parts may be axially assembled. No pin is required. The milling or cuts and the pin necessitated by the piano type hinge are not required, thereby effecting a considerable lost saving. The particular form of bearing described herein is favored because I have found it conveniently formed by extrusion. In the embodiment of FIGS. 1 to 5, only a small depth milling at the head 38 is used to insert the rollers 50. In the embodiment of FIGS. 8 to 10, no milling is required and the entire bending device except for parts of the frame may be made solely by extrusion.

Step 1

Let it be assumed that the handle bar 66 has been slid into position as shown in FIG. 6. The flanged channel bending device or bending leaf 10 has its vertical actuating portion 32 in the vertical initial fiducial starting position of FIG. 3 abutting the stop flange 22. Let it also be assumed that a suitable-sized blank of sheet metal has been inserted between the lower and upper clamping jaws 12 and 14 respectively in a suitable position for producing the first bend, with a portion cantilevered from the bending edge 14A of the jaw 14. To produce the first bend Y-1, A-1, the operator grasps the portion 64 of the handle bar 66 and pulls it upward in the direction indicated by the arcuate arrow in FIG. 4 until the first side wall Y-1 of the flanged channel workpiece W is bent against the edge 14A of the upper jaw 14 at right angles to the first flange Z-1 (FIG. 4). As the bending device or crank 10 is swung upward, i.e., clockwise as viewed in FIG. 4, the pressure rollers 50 on the shaft 44 in the forwardly-projecting L-shaped, horizontally bending portion 36, 38 and head 37 roll harmlessly over the inner surface of the first side wall Y-1, while applying the bending pressure thereto without scoring, marring or otherwise damaging that surface because the so-called wiping action otherwise present in the absence of the rollers 50 has been eliminated. The bending device is then returned to its vertical starting position (FIG. 3). Once axially engaged, the leaf or bending device 10 and the base are retained in assembly during operation despite their relative motion to be described, by the contact of the wall of the bending leaf 10 and projection 31 respectively with the exterior concave and interior concave surfaces 26A and 31B of the stationary first component 26.

Step 2

The operator now unclamps the first flange portion Z-1 from between the upper and lower jaws 14 and 12 and reverses the position of the workpiece W so that the first flange Z-1 is directed downward at right angles to the first side wall Y-1 which has just been bent. The remainder of the sheet is then in the same plane as the first bent side wall portion Y-1 and inserted between the upper and lower jaws 14 and 12 to the depth therebetween that will produce the proper depth of the channel, that is, so that the corner between the bottom, and Y-1, the first-made side wall, is at the edge 14A. The operator again swings the bending device or crank 10 upward in the direction of the arrow in FIG. 4, thereby producing the bend between side wall Y-1 and the channel bottom portion or web portion X when that portion is at right angle to the first side wall Y-1. The bending device 10 is again restored to its vertical starting position of FIG. 3.

Step 3

Having completed the bends between the right angle flange Z-1 and the side wall Y-1 and the right angle bend between the side wall Y-1 and the web or bottom X of the channel the workpiece W is again reversed. The portions designated Y-2 and Z-2, are in a single plane with the bottom portion X at this point. The planar portions Y-2 and Z-2 are clamped between the lower workpiece clamping jaw 12 and the upper jaw or anvil 14 with the future corner between the side wall Y-2 and the web X located at the edge 14A. The crank is, of course, in its initial position with the vertical plate 42 against the forward vertical stop flange 22. In this position (not illustrated), the flange Z-1 lies next to the crank arm 32 in its initial positions when the crank arm or plate portion 32 in a vertical plane. The crank is not turned clockwise as viewed in FIG. 4 and the corner X, Y-2 is formed.

Step 4

To produce the right angle bend between the second side wall portion Y-2 and the flange Z-2, the operator unclamps the remainder of the workpiece blank, withdraws it from between the upper and lower jaws 14 and 12, again turns it upside down and reinserts the same portion between the upper and lower jaws 14 and 12, leaving the exposed portion of precisely the same width as the first side wall Y-1.

The proper depth of insertion is fixed by the position of the front surface 70 when the vertical plate portion or drive arm 32 is positioned against the stop or stope flange 22. In this position the drive arm 32 lies entirely on one side of the vertical plane perpendicular to the clamped planar workpiece portion that includes the edge 14A of the jaw 14 and also the axis 27, and the front planar surface 70 lies in this plane. Therefore the distance of the second flange Z-2 from the bottom X is made the same as the distance of the first flange Z-1 from the bottom X simply by applying the incipient channel over the head 37 of the crank with the flange Z-2 bearing against planar surface 70 as shown in FIG. 3.

The operator now repeats the bending operation as shown in FIGS. 4 and 5 with the rollers 50 pushing the second side wall portion Y-2 upward into perpendicularity and with the workpiece flange portion Z-2 remaining between the clamping jaws 14 and 12. During this procedure, the parts pass from the position shown in FIG. 3 through the position shown in FIG. 4 to the ultimate position shown in FIG. 5, completing the bending of the workpiece W into the "hat-shaped" form shown in FIG. 7. The operator now again unclamps the upper and lower jaws 14 and 12 from the remaining flange portion Z-2 of the workpiece W and withdraws the flange portion Z-2 from between them. The flanged channel workpiece W thus produced has the finished appearance shown in FIG. 7, being a flanged U-shaped workpiece product with right angle flanges and right angle bends at the bottom of the U channel.

The present invention by the provision of the short L-shaped arm consisting of the flange 36 and bosses 38 projecting forward and upward from the plate portion 32 of the bending device 10 enables the channel workpiece W to be produced since the short arm portion consisting of the bosses 38 together with the upwardly-projecting portion of each of the rollers 50 is of less extent than the width of the channel bottom or web X. More specifically, the largest dimension of the head circumferentially must not be greater than the inner side-wall to side-wall dimension of the channel. Then the head may fit into the channel during a step such as Step 4 described above. Furthermore, the head 37 radially must not extend from axis 27 more than the inner depth of the channel plus the distance from the axis 27 to the edge 14A.

Embodiment of FIGS. 8, 9 and 10

Another embodiment of the invention is illustrated in FIGS. 8, 9 and 10, like parts bearing like reference numerals, only the changed or different portions are differently referenced. Instead of mounting in the key hole shaped pivot grooves 42, roller shafts and rollers as in the embodiment of FIGS. 1–3, in the embodiments of FIGS. 8–10 a low-friction insert 80 of plastic material or the like is inserted in the key hole shaped grooves 42. The insert 80 is formed in a shape complementary to the key hole shape so that upon insertion of the insert in the pivot grooves 42, it is held in place. The exposed portion of the insert 80 completes the head 37 and during operation its face bears against the workpiece W. The insert 80 may be made of nylon, polyvinyl chloride or the like so that the low-friction surface of the nylon does not mark or disfigure the surface of the workpiece while the bending action is taking place, even though there is some sliding between the workpiece surface and the surface of the insert 80.

The vertical plate portion 34 as noted, may be considered as the drive arm for the crank, and the head 37 may be considered as the driven arm. The head 37 has a shoulder 37A which creates between the shoulder and the upstanding portions 37C a depression 37B which extends from the substantially cylindrical internally exposed surface 30A to the upstanding portion 37C. Seated within the depression 37B and preferably extending entirely along the axial extent of the axially extended crank 10 is inserted a filler 82 preferably of a compressible, spongy material such as foam rubber. The filler 82 bears against the upstanding shoulder 37A and against the larger diameter surface 26A of the stationary pivot component 26 on one side. On the other side, the filler 82 bears against the upstanding portion of the head 37C and further extends against the multiple upstanding bosses 38. The filler 82 is applied to the crank arm 37 with any suitable adhesive so that it firmly adheres to, and is carried by, the head 37. I have found foam rubber to be suitable material for the filler 82.

Operation of Embodiment of FIGS. 8, 9 and 10

The operation with the changes as shown and illustrated in FIGS. 8–10 is similar to the operation as described with reference to FIGS. 1–6 except that the filler 82 provides a protection for the workpiece and the bearing which will be apparent from a consideration of FIGS. 9 and 10. FIG. 9 illustrates a possible initial position of the crank in preparation of the bending of the workpiece W against the bending adge of the upper jaw or anvil 14. As the crank is turned, the portion of the workpiece beyond the jaw 14 is turned upward, while the nylon insert 80 rubs somewhat against the workpiece W. Although there is some rubbins action, because of the well known lubricating effect of nylon there is substantially no wear or marking of the workpiece, although pieces of dirt may be rubbed off. At the same time the filler 82 is turned by the head toward the jaw edge to bear against the corner formed by the workpiece and holds the corner firmly against the edge of the jaw or anvil 14. Because the axis of rotation of the crank at 27 is directly beneath the edge of the jaw 14 the filler 82 bears against the corner of the workpiece being formed and tends to support it. This support has the tendency to retain against the workpiece any finish such as paint, glaze, or enamel and tends to prevent or sustain the finish against cracking or breaking. It also tends to make a uniform bend. Further, the filler 82 covers and protects the bearing from the infiltration of any particles of dirt or the like from the workpiece or the anvil which might tend to intrude into the bearing.

It will be apparent from the foregoing that there has been described an improved brake for sheet metal or the like, and an improved crank for bending device for the sheet metal brake. The brake is economical to manufacture and also enables the formation of a channeled workpiece with right angle flanges by a simple and easy method.

I claim:

1. A brake for workpiece of sheet metal or the like comprising:

a base, a jaw connected to said base having a linear edge about which the workpiece is to be bent, means connected to the base for clamping a planar portion of the workpiece against said jaw leaving exposed a portion of the workpiece to be bent against said edge a bearing connected to said base, a crank for mounting on said bearing, the bearing affording a linear axis of rotation for said crank, the axis and the line of said edge lying in a common plane and on opposite sides of the plane of the planar portion when clamped, the crank comprising (a) a drive arm and (b) a head as a driven arm for exerting a bending force on the exposed portion of the workpiece against said edge when the drive arm is driven in one direction about said axis, said bearing receiving said crank and being engaged with said bearing by axial movement onto the bearing, and during engagement may be rotated on the bearing about the axis but cannot be radially disengaged, and said bearing comprising a member having an external cylindrical bearing surface of a first radius of curvature centered on said axis, said member having a second external cylindrical bearing surface of a second radius of curvature greater than said first radius and centered on said axis, and said bearing surfaces being diametrically remote with respect to each other relative to said axis.

2. A brake as claimed in claim 1, said crank having a first internal surface to cooperate with and bear against the smaller radius bearing surface and a second internal surface to cooperate with and bear against the larger radius bearing surface, the said internal surfaces being separated by less than the diametral distance between said external surfaces thus to prevent said radial disengagement.

3. A brake as claimed in claim 1, said crank further comprising a protective filler of compressible material between said head and said bearing, said filler being positioned to be rotated about said axis when said crank is driven in the one direction toward and against the workpiece at the jaw edge as the workpiece is being bent.

4. A brake for a workpiece of sheet metal or the like comprising:

a base, a jaw connected to said base and having a linear edge about which the workpiece against said jaw with a further portion extending from said jaw, a crank having a crank drive arm on the same side of said jaw as the workpiece when clamped, a bearing for said crank, said bearing being connected to said base and having a linear axis of rotation parallel to said linear edge and on the other side of said planar portion, when clamped, from said jaw, said axis and said edge lying in substantially the same plane which is perpendicular to the plane of said planar portion when clamped, said crank having a head projecting transverse to said crank arm for bearing against, and exerting a bending force on, the portion of the workpiece when the planar portion is clamped and when said crank driving arm is driven about said axis of rotation in one direction with the aid of said bearing, and a filler of compressible material between said head and said bearing and arranged to be rotated about said axis toward and against the workpiece at the jaw edge as the workpiece is bent when said crank is driven in the one direction.

5. A brake for bending a sheet metal workpiece comprising a base, a jaw overlying the base and having an elongated front bending edge, means for clamping a portion of a workpiece between said jaw and said base, a portion of said workpiece being cantilevered beyond the jaw edge, said base having a depending, forwardly projecting bearing lip generally underlying said jaw edge, said lip having an exterior arcuate bearing surface and an interior arcuate surface, and said lip terminating in an enlarged protuberence concentric with said interior arcuate surface, a bending leaf having a generally vertical actuating portion and a generally horizontal bending portion for underlying the cantilevered workpiece portion, means securing said bending leaf to said base for pivotal movement, including a projecting on said bending leaf which is generally parallel to said bending portion and which extends into the interior of said lip, for contact with said protuberence, and an arcuate wall on said bending leaf which underlies said projection and which is concentric with the exterior lip surface, the leaf and the base being retained in assembly during pivotal movement of said bending leaf by contact of said bending leaf wall and projection with said exterior surfaces and said protuberence, respectively, of said bearing lip, and the bending portion of said leaf, during such pivotal movement, contacting the cantilevered workpiece portion to bend the same at said jaw edge.

6. A brake for bending a sheet metal workpiece comprising an elongated base, a jaw overlying the base and having an elongated front bending edge coextensive with said base, means for clamping a portion of a workpiece between said jaw and said base, a portion of said workpiece being cantilevered beyond the jaw edge, said base having a coextensive depending, forwardly projecting bearing lip generally underlying said jaw edge, said lip having an exterior convex bearing surface, an interior recess and a cylindrical enlargement located in the recess to be concentric with said exterior convex surface, a bending leaf having a bending portion for underlying the cantilevered workpiece portion, means hingedly interconnecting said bending leaf and said base for pivotal movement, including a projection coextensive with said bending leaf and generally parallel to said bending portion, said projection extending into the lip recess and into contact with said enlargement, and an arcuate concave bearing wall generally underlying said projection for concentric bearing contact with said exterior convex lip surface, pivotal movement of said bending leaf being accommodated and guided by the contact of said bending leaf wall and with said exterior lip surface, radial separation of the bearing surfaces being prevented by projection-enlargement contact, and and the bending portion of said leaf, during such pivotal movement, contacting the cantilevered workpiece portion to bend the same at said jaw edge.

7. In a brake for bending a workpiece of sheet metal or the like, an extruded base, a clamping structure overlying the base, means for clamping to the base a workpiece interposed between the base and the clamping structure, so that a portion of the workpiece projects beyond the base and the clamping structure, and an extruded bending leaf having a bending leg underlying the projecting workpiece portion and a depending actuating leg;

the improvement of means interconnecting the base and the bending leaf and accommodating elevation of the bending leg relative to the base to bend the projecting portion of the workpiece, said means including a partial cylindrical convex surface on said base, a complementary partial cylindrical concave surface on said bending leaf, an interior cylindrical enlargement on said base concentric with said surfaces, and a projection on said bending leaf in extended surface contact with said enlargement.

8. In a brake for bending a workpiece of sheet metal or the like, an extruded base, a clamping structure overlying the base, means for clamping to the base a workpiece interposed between the base and the clamping structure, so that a portion of the workpiece projects beyond the base and the clamping structure, an extruded bending leaf having a bending leg underlying the projecting workpiece portion and a depending actuating leg, the improvement of means interconnecting the base and the bending leaf and accommodating elevation of the bending leg relative to the base to bend the projecting portion of the workpiece, said means including integrally extruded hinge components having concentric sliding surfaces on said leaf and said base, respectively, guiding the bending leaf during its entire movement relative to the base, and interengaging additional surfaces on said base and said leaf, respectively, said additional surfaces including a protuberance located internally of one of said concentric sliding surfaces and a projection on the other of said concentric sliding surfaces, said protuberance and said projection being in constant sliding contact during elevation of said bending leg to prevent radial separation of said concentric surfaces, and said base and said bending leaf being assembled by relative axial displacement of said hinge components.

9. In a brake for bending a sheet metal workpiece and having an extruded base, a jaw overlying the base and having an elongated front bending edge, means for clamping a portion of a workpiece between said jaw and said base, a portion of said workpiece being cantilevered beyond the jaw edge, and an extruded bending leaf having an actuating portion and a bending portion normal to said actuating portion for underlying the cantilevered workpiece portion;

the improvements comprising means hingedly interconnecting said base and said bending leaf, said means including a depending, forwardly projecting bearing lip integrally extruded with said base to generally underlie said jaw edge, said lip having an exterior arcuate bearing surface and an interior arcuate surface defining a bearing recess generally vertically aligned with said jaw edge, said lip terminating in a cylindrical protuberence concentric with said exterior surface and vertically aligned with said jaw edge;

means integrally extruded with said bending leaf at the juncture of the actuating and bending portions, including a projection generally parallel to said bending portion and extending into the bearing recess into extended contact with said lip protuberence, and an arcuate wall generally underlying said projection and concentric with the exterior lip surface;

so that, upon pivotal movement of said bending leaf, the leaf and the base are retained in assembly by sliding contact of said bending leaf wall and projection with said exterior surface and said protuberence, respectively, of said bearing lip, and the bending portion of said leaf, during such pivotal movement, contacts the cantilevered workpiece portion to bend the same at said jaw edge.

10. In a brake for bending a workpiece of sheet metal, and including a movable jaw for clamping the workpiece against a fixed base with a portion of the workpiece projecting freely in a substantially horizontal plane beyond the confines of said jaw and said base, said jaw having an edge which overlies the horizontal plane to define a linear edge about which the projecting portion of said workpiece can be bent upwardly, the improvements of a bending leaf underlying said projecting workpiece portion and a partially annular convex bearing projection formed integrally with said base to be concentric with a pivot axis which is substantially vertically aligned with said jaw edge, said leaf having a substantially vertical actuating arm, a substantially horizontal bending arm, and a concave arcuate bearing surface at the juncture of said arms, the exterior surface of said annular projection of said base being concentric with said concave arcuate surface formed on said leaf and in peripheral sliding contact therewith to guide the leaf for travel in an arcuate path about said pivot axis, an additional projection on said leaf extending into the annular bearing projection of the base and contacting the interior of said projection to prevent radial separation of said bearing surfaces and the bending arm of said leaf contacting the projecting portion of the workpiece upon arcuate movement of the leaf to bend the workpiece about said jaw edge, said partially annular convex bearing projection having a radial interior projection terminating in a protuberance located substantially at said pivot axis, and said additional projection on said leaf contacting said protuberance to prevent radial separation of said bearing surfaces.

11. In a brake as claimed in claim 10, the further improvement of a protective filler of compressible material carried by said bending arm and movable therewith, as said leaf is moved toward and against the workpiece at the jaw edge, the compressible material contacting the workpiece as the workpiece is being bent.

12. In a brake as defined in claim 10, the further improvement of said leaf having its bending arm extending laterally to project outwardly from the vertical actuating arm, and said bending arm being of limited vertical extent to accommodate its entry into a previously bent portion of the workpiece.

13. In a brake as defined in claim 12, the further improvement of the outer edge of said vertical actuating arm being aligned vertically with said jaw edge to serve as a locating stop for the previously bent portion of the workpiece.

* * * * *